US005456656A

United States Patent [19]

Skovira

[11] Patent Number: 5,456,656

[45] Date of Patent: Oct. 10, 1995

[54] DEVICE FOR MASSAGING AN ANATOMICAL PORTION OF A BODY OF A PERSON

[76] Inventor: Gregory M. Skovira, 500 Hadfield Rd., Downingtown, Pa. 19335

[21] Appl. No.: 125,942

[22] Filed: Sep. 23, 1993

Related U.S. Application Data

[63] Continuation-in-part of Ser. No. 996,300, Dec. 23, 1992, abandoned.

[51] Int. Cl.[6] ..... A61H 7/00

[52] U.S. Cl. ..... 601/84; 601/134

[58] Field of Search ..... 601/84, 107, 108, 601/115, 117, 133, 134, 135

[56] References Cited

U.S. PATENT DOCUMENTS

| | | | |
|---|---|---|---|
| 2,461,102 | 2/1949 | Ackerman | 128/33 |
| 3,209,747 | 10/1965 | Guentner | 128/28 |
| 3,799,155 | 3/1974 | Gerlich | 128/44 |
| 3,965,893 | 6/1976 | Ragailler | 128/28 |
| 4,041,938 | 8/1977 | Wintoniw | 128/52 |
| 4,721,100 | 1/1988 | Hengl | 128/57 |
| 4,751,919 | 6/1988 | Thomsen | 128/66 |
| 4,875,470 | 10/1989 | Cotone | 128/57 |
| 4,908,016 | 3/1990 | Thomsen | 128/66 |
| 4,984,568 | 1/1991 | Persaud | 601/122 |
| 5,016,617 | 5/1991 | Tarlow et al. | 128/52 |
| 5,022,386 | 6/1991 | Kuniskis | 128/57 |
| 5,078,125 | 1/1992 | Schumacher | 128/52 |
| 5,083,552 | 1/1992 | Lipowitz | 128/44 |
| 5,101,809 | 4/1992 | Daffer et al. | 128/33 |
| 5,101,835 | 4/1992 | Del Re | 601/122 |

FOREIGN PATENT DOCUMENTS

| | | | |
|---|---|---|---|
| 482988A | 4/1992 | European Pat. Off. | 128/24 R |

*Primary Examiner*—Robert A. Hafer
*Assistant Examiner*—David J. Kenealy
*Attorney, Agent, or Firm*—Panitch Schwarze Jacobs & Nadel

[57] ABSTRACT

The invention is a sensor in a system for massaging a portion of a body of a person. The system includes a frame and a body supporting surface mounted on the frame. An applicator is also supported by the frame proximate to the body supporting surface in order to apply a force to the body portion. A sensor for sensing the applied force and providing a control signal in response to the sensed force is provided between the frame and the applicator. A control device moves the applicator with respect to the body portion in response to the control signal from the sensor. The sensor is provided with a sensor surface and a position determining device for determining the position of the sensor surface. The sensor then provides a control signal in response to the determined position. Another sensor surface, spaced apart from the first sensor surface by resilient material, may also be provided. The control signal is then determined according to the distance between the first and second sensor surfaces.

10 Claims, 4 Drawing Sheets

DEVICE FOR MASSAGING AN ANATOMICAL PORTION OF A BODY OF A PERSON

CROSS REFERENCE TO RELATED APPLICATION

This is a continuation-in-part of U.S. patent application Ser. No. 07/996,300, filed Dec. 23, 1992 now abandoned.

FIELD OF THE INVENTION

The present invention relates generally to a device for massaging the human body and, more particularly, to a device for applying therapeutic massage to a portion of the human body while the body is positioned on a support surface.

BACKGROUND OF THE INVENTION

Numerous massage machines have been developed for massaging the human body in an attempt to stimulate circulation, tone up the muscles and to improve the general health of the user when the machine rolls against the body, oscillates rotationally or simply vibrates. Certain types of existing devices have massage applicators which are supported by, or embedded into, a structure, such as a chair, table or back cushion. In these types of devices, the applicators are driven by an electric motor which eliminates the need for manual assistance in the massaging process. However, the movement patterns and ranges for the applicators are limited and usually confined to specific areas of the body and, therefore, are not suitable for massaging an entire region of the body.

Hand-held massagers, also in general use, can be applied to any area of the body, but are difficult to use and tedious. Effective massaging with hand-held devices requires repetitious manual movement of the applicator for extended periods of time. Furthermore, certain areas of the body cannot easily be reached by a person applying the applicator for self-massage. To obtain an effective massage to cover all areas of the body, a second individual is required.

Devices for specifically massaging the back and spinal area have included machines wherein the entire massaging apparatus is deposed beneath a body supporting table surface such that massage wheels or other pressure exerting components may apply pressure upwardly, through the table surface, so as to massage the spinal area of a human subject lying in a generally supine position on a table surface. Other devices for specifically massaging the back and spinal area have included machines wherein the entire massaging apparatus is disposed above a body supporting surface such that massage wheels or other pressure exerting components may apply pressure downwardly to massage the spinal area of a human subject lying in a generally prone position on a table surface.

Devices which apply pressure downwardly to a portion of the human body which is positioned on a table surface include safety features which limit the amount of pressure that can be applied downwardly to prevent the device from applying excessive compressive pressure and injuring the body portion. Such devices typically include a force or pressure sensing switch which is actuated when a preset force or pressure is exceeded. Such devices are problematic in that in the event of a switch or other electrical failure, the safety feature is rendered inoperative. Such a failure could occur during use of the device and, therefore, may result in injury to the human body lying on the support surface. Hence there is a need for such a massaging device which can limit the maximum pressure applied to the human body which does not rely upon an external power source.

Moreover, massaging devices are also problematic because they typically only sense the applied force along a single axis, usually a vertical axis. Such massaging devices use the sensed force as feedback to control the amount of force applied to the body portion in accordance with a predetermined force selected by the user. However, typical massaging devices apply forces horizontally because the applicator moves horizontally across the human body which is not planar. For instance, as an applicator moves upwardly and horizontally over and in engagement with an inclined portion of the body, horizontal forces are applied due to friction and the inclination of the body. Conventional massaging devices do not include any means for sensing the forces applied horizontally against the human body and, therefore, the applicator is not accurately controlled to provide the selected predetermined force.

The present invention is directed to a sensor device in a system for massaging a portion of the human body which is positioned on a supporting surface by applying a compressive pressure downwardly toward the supporting surface. The system of the present invention uses a control signal from the sensor device to mechanically limit the maximum amount of pressure applied to the human body. Using the present invention the forces applied to the human body along both vertical and horizontal axes are sensed and controlled to accurately apply the selected massaging forces. Hence, the present invention provides a safer and more accurate massage of the human body.

SUMMARY OF THE INVENTION

Briefly stated, the present invention is a sensor device in a system for massaging an anatomical portion of a body of a person. The system includes a frame and a body supporting surface mounted on the frame for supporting the body portion. An applicator means is supported by the frame proximate the body supporting surface for movement with respect to the body supporting surface to engage and apply a force to the body portion. Control means are coupled to the applicator means to move the applicator means to various positions over the body portion and to apply varying amounts of force to the body portion. The sensor device is positioned between the applicator and the frame in order to sense the amount of force applied to the body portion and provide a control signal according to the sensed force. The controller receives the control signal and moves the applicator accordingly. In particular the sensor may be formed of parallel plates separated by either a foam pad having an inductive transducer or an air bladder having a pressure transducer.

BRIEF DESCRIPTION OF THE DRAWINGS

The foregoing summary, as well as the following detailed description of the presently preferred embodiment of the invention will be better understood when read in conjunction with the appended drawings. For the purpose of illustrating the invention, there is shown in the drawings, an embodiment which is presently preferred. It should be understood, however, that the present invention is not limited to the particular arrangement and instrumentality shown. In the drawings.

DETAILED DESCRIPTION OF THE PREFERRED EMBODIMENT

Figure 1:
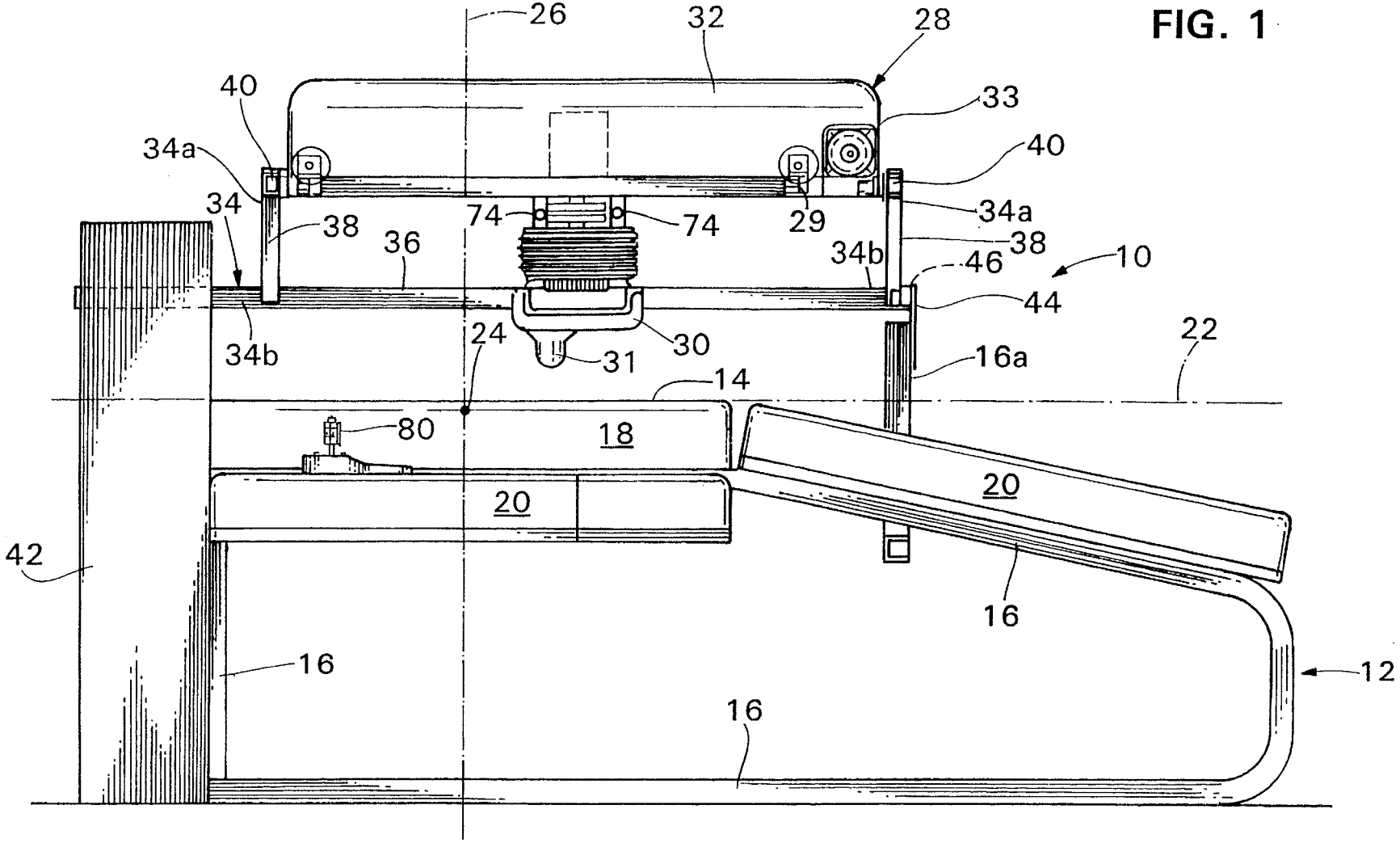
FIG. 1 is a side elevational view of a device for massaging an anatomical portion of a body of a person in accordance with the present invention.

Certain terminology is used in the following description for convenience only and is not limiting. The words "right", "left" "lower" and "upper" designate , directions in the drawings to which reference is made. The words "inwardly" and "outwardly" refer to directions toward and away from, respectively, the geometric center of the device and designated parts thereof. The terminology includes the words above specifically mentioned, derivatives thereof and words of similar import.

Referring to the drawings in detail, wherein like numerals indicate like elements throughout, there is shown in FIGS. 1 through 6B a preferred embodiment of a device, generally designated 10, for massaging an anatomical portion of a body of a person (not shown) in accordance with the present invention. The device includes a frame 12 and a body supporting surface 14 mounted on the frame 12 for supporting the body portion. In the present embodiment, it is preferred that the frame 12 be comprised of a series of interconnected tubular frame members 16 which are generally square in cross-section. The frame members 16 are preferably constructed of a metallic material, such as steel, and are fastened together by standard fasteners, such as nuts and bolts (not shown).

It is understood by those skilled in the art that the particular construction of the frame 12 is not pertinent to the present invention and that any suitable type of supporting structure could be used without departing from the spirit and scope of the invention. Accordingly, further description of the frame 12 is omitted for purposes of convenience only, and is not limiting.

Referring now to FIG. 1, it is preferred that the body supporting surface 14 be comprised of a pad 18 affixed to the frame 12. The pad 18 receives the portion of the body which is to be massaged. In the present embodiment, it is preferred that the pad 18 receive the upper torso of the human body in a face down manner such that the back and spinal area face upwardly away from the pad 18. Secondary pads 20 are also secured to the frame 12 for supporting other portions of the body, such as the arms and legs. The secondary pads 20 provide the person to be massaged with a degree of comfort. It is understood by those skilled in the art that the present invention is not limited to massaging any particular portion of the body. That is, the human body can be positioned on the pad 18 in any manner to massage different areas of the body, such as the chest or legs.

Figure 2:
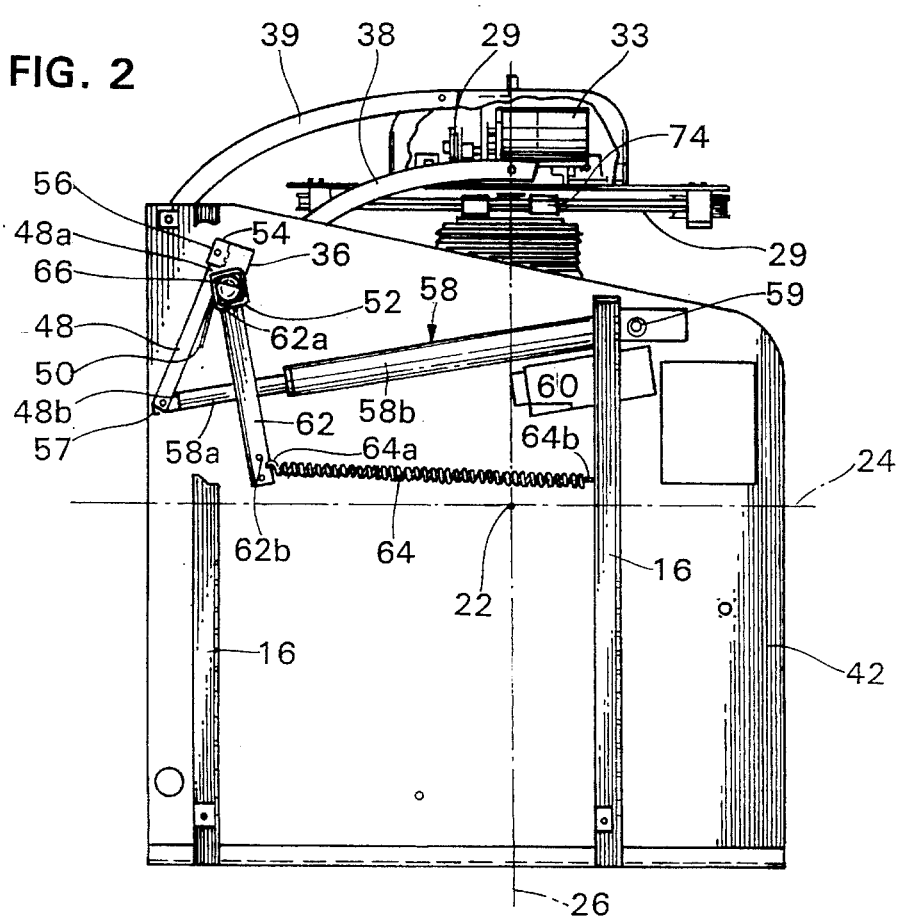
FIG. 2 is a front elevational view, partially broken away, of the device shown in FIG. 1 in a first position.

Referring now to FIGS. 1 and 2, the body supporting surface 14 has a first generally horizontal longitudinal axis 22 extending therethrough. A second generally horizontal axis 24 extends generally perpendicular to the first axis 22. The second axis 24 extends outwardly from FIG. 1. A third generally vertical axis 26 extends generally perpendicular to the first and second axes 22, 24.

Figure 4:
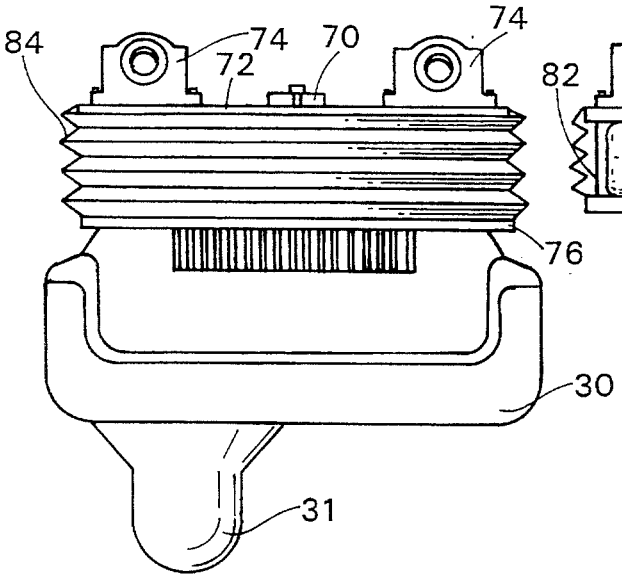
FIG. 4 is a side elevational view of an applicator of the device shown in FIG. 1.
Figure 3:
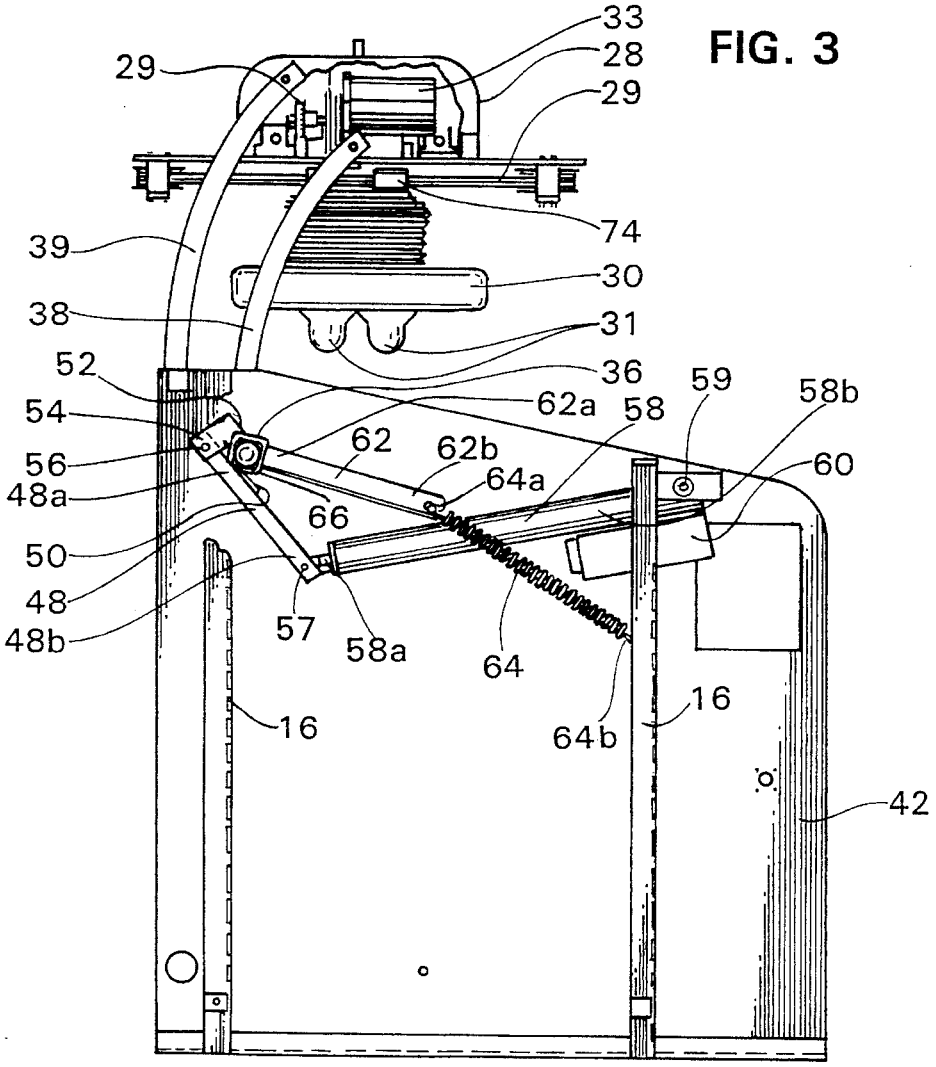
FIG. 3 is a front elevational view, partially broken away, of the device shown in FIG. 1 in a second position.

Referring now to FIGS. 1, 3 and 4, the device 10 includes applicator means supported by the frame 12 proximate the body supporting surface 14 for movement with respect to the body supporting surface 14 to engage and apply a force to the body portion. In the present embodiment, it is preferred that the applicator means be comprised of a carriage 28 mounted to move with respect to the frame 16, as described in more detail hereinafter. The applicator means further comprises an applicator 30 extending from the carriage 28 for engagement with the body portion to apply the force to the body portion. The applicator 30 includes a pair of downwardly extending projections 31 which engage and apply forces to the body portion, as best shown in FIG. 3. Housed within the applicator 30 is a standard vibrator mechanism for vibrating the projections 31, as is understood by those skilled in the art. More particularly, the applicator 30 is of the shiatsu type which is available off the shelf from several manufacturers. However, other applicators could be used without departing from the spirit and scope of the invention.

The carriage 28 includes a casing 32 for housing a drive system to move the applicator 30 in a plane generally parallel to the first and second axes 22, 24. In the present embodiment, it is preferred that the drive system be comprised of a pair of stepper motors 33 for driving a belt and rail system 29 (only partially shown). It is understood by those skilled in the art that the drive system is not pertinent to the present invention and can be constructed of any standard drive elements for moving an applicator 30 along two axes. Accordingly, further description of the drive system is omitted for purposes of convenience only and is not limiting.

Referring now to FIGS. 1 through 3, the device 10 includes control means coupled to the applicator 30 for moving the applicator 30 between a first position (shown in FIG. 2) wherein the applicator is in engagement with the body portion and a second position (shown in FIG. 3) wherein the applicator 30 is disengaged from the body portion. When the applicator 30 is in the first position and it is desired that the maximum force be applied to the body portion, the control means is uncoupled from the applicator 30 to limit the maximum force applied to the body portion by the applicator 30 as described in more detail hereinafter. In the present embodiment, it is preferred that the maximum force be equal to the combined weight of the applicator 30 and casing 32 less a counterbalancing force which is also described in more detail hereinafter.

Referring now to FIG. 1, the control means preferably includes mounting means for supporting the applicator 30 proximate the body supporting surface 14. In the present embodiment, it is preferred that the mounting means be comprised of a torsion bar 34 having a first end **34*a* secured to the carriage 28 and applicator 30 and a second end 34*b*. The torsion bar 34 includes an elongated generally cylindrical rod 36 mounted proximate the body supporting surface 14 and extending generally parallel to the first axis 22**.

The rod 36 forms the second end 34*b* of the torsion bar 34. Extending outwardly from the rod 36 is a pair of spaced generally arcuate legs 38. Each leg 38 has a terminal end which is pivotally connected to the carriage 28 at opposed ends thereof by a standard hinge connection 40 for allowing the carriage 28 to pivot with respect to the torsion bar 34.

With reference to FIGS. 1 and 2, there is shown hinge means interconnected between the frame 16 and the second end 34*b* of the torsion bar 34 for allowing the torsion bar 34 to move between the first position (FIG. 2) wherein the applicator 30 is in engagement with the body portion and the second position (FIG. 3) wherein the applicator 30 is disengaged from the body portion. In the present embodiment, the hinge means is preferably comprised of pivotally mounting the rod 36 to the frame 12. That is, at the head end of the pad 18 is a housing 42 which pivotally receives one end of the rod 36. The housing 42 includes a suitably sized aperture (not shown) for pivotally receiving the rod 36. The other end of the rod 36 is pivotally mounted to the frame 12 by a hinge pin mount 44 extending from a vertically extending frame member 16*a*. The hinge pin mount 44 includes a pin 46 extending into an open end of the rod 36. A stabilizer bar 39 (only shown in FIGS. 2 and 3) is pivotably connected between the casing 28 and housing 42 for stabilizing the carriage 28 in a horizontal position as the torsion bar 34 moves between the first and second positions.

The particular manner in which the rod 36 is pivotally mounted to the frame 12 is not pertinent to the present invention. That is, the torsion bar 34 or rod 36 could be pivotally mounted to the frame 12 in a number of different manners without departing from the spirit and scope of the invention. For instance, the other end of the rod 36 could extend into a suitably sized aperture (not shown) in the vertically extending frame member 16*a*. Accordingly, further description of the mounting of the torsion bar 34 is omitted for purposes of convenience only and is not limiting.

Referring now to FIGS. 2 and 3, there is shown actuator means secured to the torsion bar 34 for pivotally moving the torsion bar 34 between the first and second positions and for allowing the torsion bar 34 to move with respect to the actuator means when the torsion bar 34 is in the first position (FIG. 2). In the present embodiment, it is preferred that the actuator means be comprised of a support arm 48 having a first end 48*a* and a second end 48*b*. The actuator means further comprises a flange 50 extending from the portion of the torsion bar 34 positioned within the housing 42. The actuator means also includes a second hinge means interconnected between the first end 48*a* of the support arm 48 and the portion of the torsion bar 34 within the housing 42 for allowing the support art 48 to pivot with respect to the torsion bar 34 and engage the flange 50 to move the torsion bar 34 from the first position (FIG. 2) to the second position (FIG. 3).

In the present embodiment, it is preferred that the flange 50 be fixed to the rod 36 by a generally square first collar 52 positioned over the rod 36 within the housing 42, although the first collar 52 could be generally circular or triangular without departing from the spirit and scope of the invention. In the present embodiment, it is preferred that the first collar 52 be fixed to the rod 36 by a pin (not shown) extending through the first collar 52 and rod 36 such that the first collar 52 rotates with the rod 36. The flange 50 extends from the first collar 52 in a first direction. In the present embodiment, it is preferred that the second hinge means be comprised of a pair of plates 54 extending from the first collar 52 in a direction opposite from the flange 50. The first end 48*a* of the support arm 48 is positioned between the plates 54. The first end 48*a* of the support arm 48 and the plates 54 include a suitably aligned aperture for receiving a pin 56 for permitting the support art 48 to pivot with respect to the first collar 52 and plates 54, as best shown in FIG. 2. That is, the first end 48*a* of the support arm 48 pivots about an axis which extends generally parallel to the longitudinal axis of the rod 36.

In the present embodiment, it is preferred that the actuator means further comprise drive means pivotally connected to the second end 48*b* of the support arm 48 by a hinge pin connection 57 for moving the support arm 48 toward and away from the flange 50. It is preferred that the drive means be comprised of a linear actuator 58 positioned within the housing 42 and secured to the frame 12. The linear actuator 58 is preferably of the ball screw type which includes an arm 58*a* which is movable between an extended position (FIG. 2) and a retracted position (FIG. 3) within a generally cylindrical casing 58*b* and is driven by a stepper motor 60 as is well understood by those skilled in the art. The casing 58*b* and stepper motor 60 are preferably pivotally mounted to one of the frame members 16 of the frame 12 within the housing 42 by a hinge pin 59 extending through the casing 58*b*. However, it is also understood by those skilled in the art that other linear actuators could be used to drive the second end 48*b* of support arm 48. For instance, a pneumatic or hydraulically actuated piston rod could be used without departing from the spirit and scope of the invention. Similarly, other means could be utilized for moving the support arm 48 with respect to the first collar 52, such as a cam drive mechanism.

As shown in FIGS. 2 and 3, the actuator means further comprises biasing means for biasing the torsion bar 34 toward the second position (FIG. 3). In the present embodiment, it is preferred that the biasing means be comprised of a spring rod 62 and a coil spring 64. The spring rod 62 has a first end 62*a* and a second end 62*b*. The first end 62*a* of the spring rod 62 is fixed to the portion of the torsion bar 34 within the housing 42. That is, the first end 62*a* of the spring rod 62 includes a generally square second collar 66 which fixedly receives the rod 36 in a manner similar to that described above in connection with the first collar 52. The spring rod 62 extends from the second collar 66 a predetermined distance. The spring 64 has a first end 64*a* connected to the second end 62*b* of the spring rod 62 and a second end 64*b* secured to a frame member 16 of the frame 12 within the housing 42. The point of attachment of the second end 64*b* of the spring 64 to the frame member 16 can, to a certain extent, determine the characteristics of the biasing force applied to the torsion bar 34 as the torsion bar 34 moves between the first and second positions.

As shown in FIGS. 2 and 3, the torsion bar 34 is movable with respect to the support arm 48 when the torsion bar 34 is in the first position (FIG. 2) and the support arm 48 is spaced from the flange 50. The support arm 48 engages the flange 50 to move the torsion bar 34 between the first and second positions.

Figure 5A:
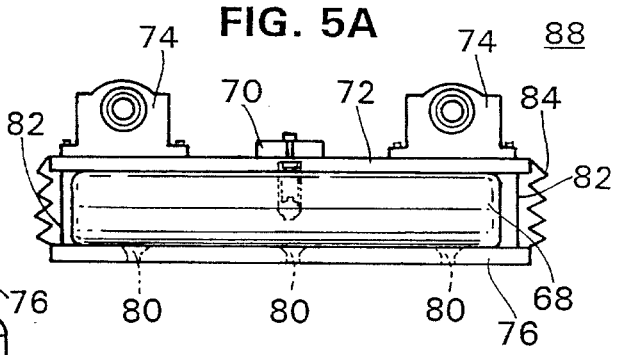
FIG. 5A is a cross-sectional view of the applicator shown in FIG. 4 taken along lines 5—5 of FIG. 4.

Referring now to FIGS. 5A,B,C, there are shown various side views of the sensors 88 (FIG. 5A), 98 (FIGS. 5B & 5C), wherein the sensors 88, 98 are alternate embodiments of a type of sensor means suitable for use with the applicator 30 of the present invention. It will be understood by those skilled in the art that it is preferred that the applicator 30 include sensor means for determining the force applied to the body portion parallel to all three of the first, second and third axes 22, 24 and 26.

Figure 5B:
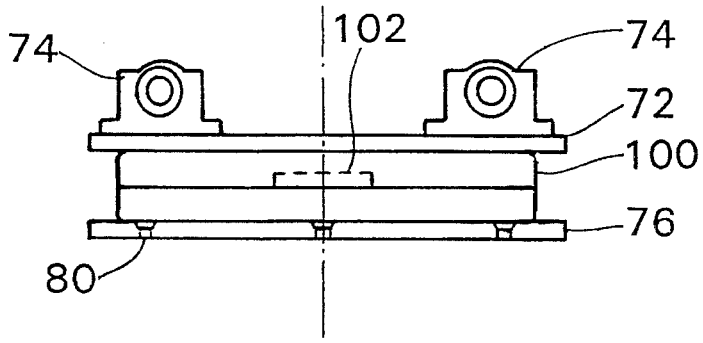
FIG. 5B is a side view of an alternate embodiment of the applicator shown in FIG. 5A.
Figure 5C:
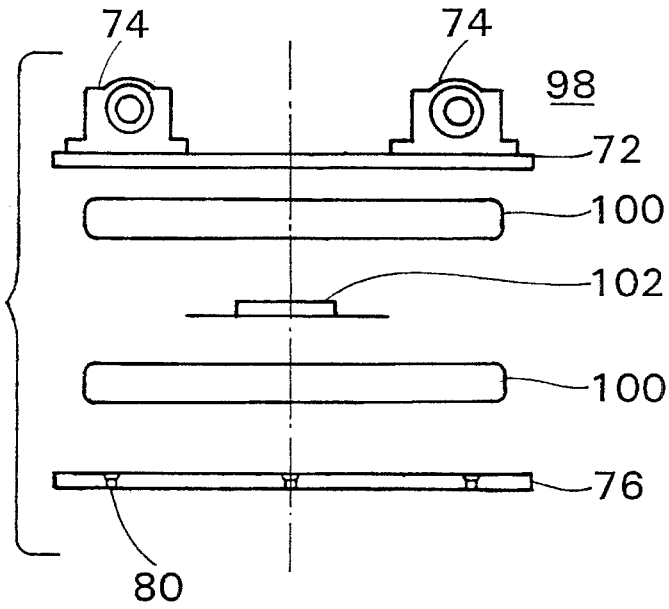
FIG. 5C is an exploded side view of the alternate embodiment shown in FIG. 5B.

For this purpose a sensor means such as a sensor 88 or a sensor 98 is positioned between the carriage 28 and the applicator 30 for sensing forces applied therebetween. The forces sensed by the sensor 88 or the sensor 98 thus correspond to the force applied to the body portion by the applicator 30. The sensors 88, 98 include two plates 72, 76 which are spaced apart by a resilient material such as an air bladder 68 (FIG. 5A) or a foam rubber pad 100 (FIG. 5B).

The plates 72, 76 of the sensors 88, 98 which form first and second sensor surfaces are housed in a bellows 84 or an accordion-like bag 84 as previously described. The bottom plate 76 moves with respect to the top plate 72 when a force is applied to the bottom plate 76 within bag 84. The distance between the two plates 72, 76 which may be formed of aluminum is a function of the force applied to the bottom plate 76 and the corresponding resistance of the material between the plates 72, 76. The bottom plate 76 does not necessarily move only in a position parallel to the top plate 72. Therefore, it is important that the sensors 88, 98 detect as much of the bottom plate 76 as possible.

The first plate 72 is preferably connected to the carriage 28 by four pillow block bearings 74 which receive rails (not shown) movable by the stepper motors 33 within the carriage 28. The first plate 72 is also connected to the second plate 76 which is in turn connected to the applicator 30. The pillow block bearings 74 are connected to the first plate 72 by standard hardware such as bolts 78 and the second plate 76 is similarly connected to the applicator 30 by screws (not shown) extending through suitably sized apertures 80 extending through the second plate 76, as shown in FIGS. 5A,B,C.

In the sensor embodiment 88 the air bladder 68 is pressure sensitive. For example, when the lower plate 76 is moved toward the upper plate 72 the pressure within the air bladder 68 increases. The air bladder sensor 88, having plates 72, 76, is positioned between the carriage 28 and the applicator 30 as previously described. Additionally, the air bladder sensor 88 has a position determining device. In the present embodiment the pressure determining device is a pressure determining or pressure sensing transducer 70 in fluid communication with the bladder 68 for sensing the pressure within the bladder 68 and providing a signal to the control means. The pressure within the bladder 68 corresponds to the force applied to the body portion by the applicator 30.

In the sensor embodiment 98 a foam pad 100 is disposed between plates 72, 76 rather than an air bladder 68. Foam pad 100 of sensor embodiment 98 may be approximately one inch thick and may be formed of two portions which are brought together to surround a position determining device, in this embodiment an inductive transducer 102. Inductive transducer 102 may be any suitable inductive sensor as well known to those skilled in the art. When a force is applied to the lower plate 76 of foam pad sensor 98, the lower plate 76 moves with respect to the upper plate 72 as previously described. This motion applies a compressing or decompressing force to foam pad 100. This compressing or decompressing force resiliently changes the distance between the plates 72, 76 and thus the inductance of transducer 102. The foam rubber material placed between the two plates 72, 76 thus acts as a spring or resistance between the two plates 72, 76 of the sensor 98. The density and shape of the foam forming foam pad 100 may be varied to obtain different characteristics of force versus distance between the plates 72, 76 within the foam pad sensor 98.

The distance between the plates 72, 76 of the sensor embodiment 98 may be sensed by the inductive sensor 102 or any other type of position sensor known to those skilled in the art which is effective to sense the change in the position of the lower plate 76. A control signal representing this position, and therefore proportional to the distance between plates 72, 76, is transmitted to the system computer by the inductive transducer 102. The system computer uses this control signal, representative of the position of the surface of the lower plate 76, as a process variable proportional to the force applied by the bottom plate 76 to the body of the user. As the force applied to the body of the user increases, the distance between the plates 72, 76 decreases. As the force decreases, the distance increases.

In the preferred embodiment of the foam pad sensor 98 one or more inductive transducers 102 may be mounted between the top and bottom plates 72, 76 in order to sense the distance between the top plate 72 and the bottom plate 76. The reliable sensing range of the inductive transducers 102 within the foam pad sensor 98 should extend from approximately one-quarter inch to approximately one inch.

Figure 6A:
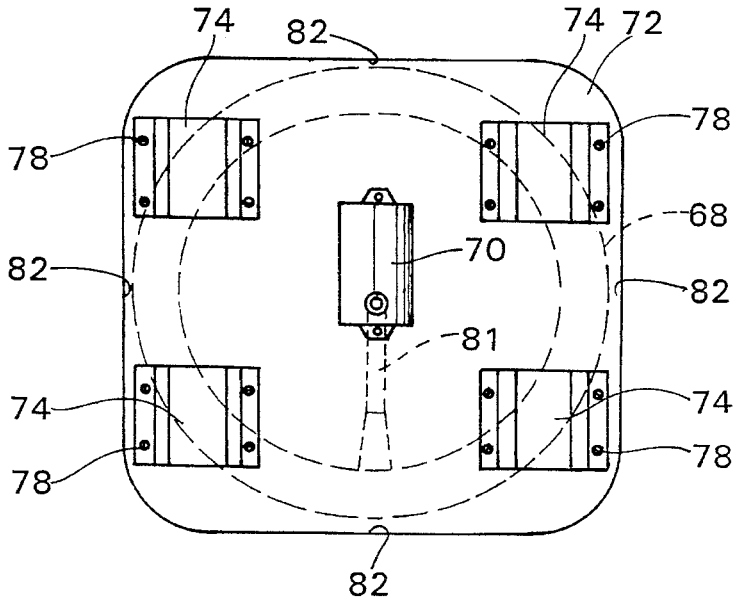
FIG. 6A is a top plan view of the applicator shown in FIG. 4.

Referring now to FIG. 6A, there is shown a top view of the air bladder sensor 88. The bladder 68 of the sensor 88 is generally annular in shape in cross section and includes a polymeric tube 81 extending inwardly along a radius. Tube 81 is interconnected between the pressure transducer 70 and the bladder 68 for communicating the pressure of the bladder 68 to the transducer 70. In a manner well understood by those skilled in the art the pressure transducer 70 provides an electrical control signal representative of the pressure within the air bladder 68. This control signal is therefore representative of the position of the surface of the lower plate 76 which presses against the air bladder 68. While it is preferred that the cross section of the bladder 68 of sensor 88 be generally annular as shown in FIG. 6A, it is understood by those skilled in the art that the bladder 68 may be of other configurations provided that plates 72, 76 are spaced apart and the transducer 70 is effective to provide the control signal representative of the force applied to bottom plate 76. For example, the bladder 68 of the sensor 88 may be generally circular or generally square without departing from the spirit and scope of the invention.

Figure 6B:
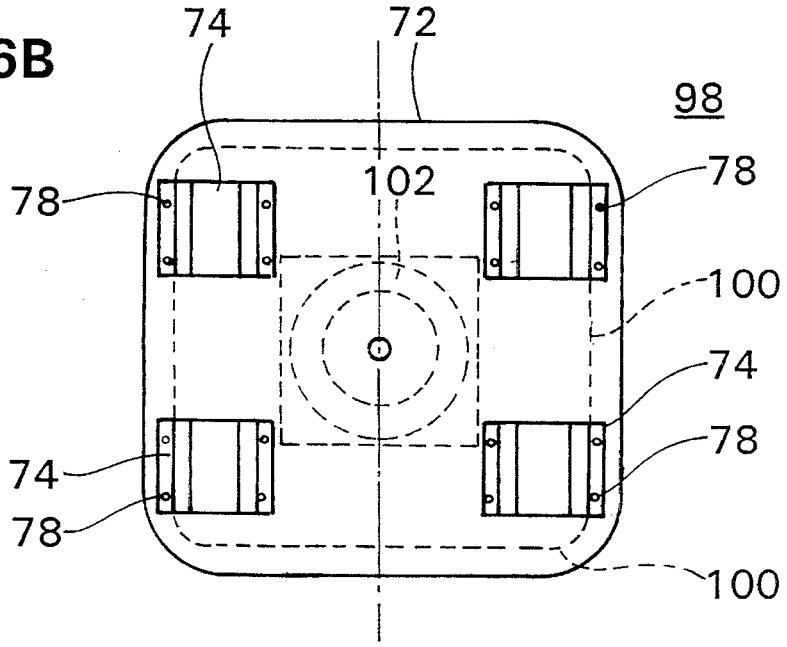
FIG. 6B is a top plan view of the alternate embodiment shown in FIG. 5B.

Referring now to FIG. 6B, there is shown a top view of the foam pad sensor 98. The cross section of foam pad 100 of the sensor 98 is generally rectangular in shape. While it is preferred that the foam pad 100 of sensor 98 be generally rectangular in shape as shown in FIG. 6B, it is understood by those skilled in the art that the foam pad 100 may be of other configurations provided that the plates 72, 76 are spaced apart and the inductive transducer 102 is effective to provide the control signal representative of the force applied to bottom plate 76. For example, the foam pad 100 of the sensor 98 may be generally circular without departing from the spirit and scope of the invention.

Referring now to FIGS. 5A,B,C and 6A,B, the top and bottom plates 72, 76 of sensors 88, 98 preferably extend generally parallel with respect to each other. Furthermore plates 72, 76 are movable with respect to each other along the first, second and third axes 22, 24 and 26. In order to provide these features the sensors 88, 98 may provide four plastic ties 82 which extend between each of the sides of the first and second plates 72, 76 to permit the second plate 76 to hang from and move with respect to the first plate 72 parallel to the first, second and third axes 22, 24, 26. The bladder 68 of the sensor 88 is preferably injected with a gas, such as air, such that it tightly fits between the first and second plates 72, 76. Thus when the top and bottom plates 72, 76 move horizontally with respect to each other pressure within the bladder 68 increases. Likewise, the sections of foam pad 100 should be snugly retained between plates 72, 76 when assembled. A bellows 84 or an accordion-like bag 84 is positioned about the first and second plates 72, 76 of both sensors 88, 98 in order to provide the device 10 with an aesthetically pleasing appearance.

The control means preferably further comprises a programmed microprocessor (not shown) contained within a computerized control unit (not shown) positioned within the housing 42. The control unit is electronically connected to the stepper motors 33 and a hand-held joy stick control pad 86 which allows a user to control movement of the applicator 30 and to program the device to perform a personalized massage. The control unit allows the user to move the applicator 30 anywhere over the shoulders, back, buttocks or thighs of the user by movement of the joy stick 86. The control unit controls the stepper motors 33 to move the carriage 28 up or down to maintain a selected constant pressure to the body of the user. The control unit controls the stepper motors 33 within the carriage 28 to move the applicator 30 anywhere along the first and second axes 22, 24 within the horizontal plane of the carriage 28. Control units of the type used in the present invention are known to those skilled in the art, see U.S. Pat. No. 5,083,552. Moreover, the specific details of the control unit for moving the actuator 30 is not pertinent to the present invention and, therefore, further description of the control unit is omitted for purposes of convenience only and is not limiting.

To move the applicator 30 from the second position (FIG. 3) to the first position (FIG. 2), the stepper motor 60 of the linear actuator 58 is actuated by the control unit to extend the arm 58*a* of the linear actuator 58 outwardly. As the linear actuator 58 extends outwardly, the flange 50 of the first collar 52 remains in engagement with the support arm 48 due to the weight of the carriage 28 and applicator 30 which begin to move downwardly toward the body supporting surface 14. The carriage 28 and applicator 30 continue to move downwardly toward the portion of the body to be massaged as the arm 58*a* of the linear actuator 58 continues to extend outwardly. Once the applicator 30 engages the body portion, the linear actuator 58 will extend or retract as required to maintain a constant pressure as sensed by the pressure bladder 68. The support arm 48 will continue to pivot with respect to the torsion bar 34 and disengage from plate 50 only if the maximum force is applied.

In this position, the support arm 48 does not apply any force to the torsion bar 34 or applicator 30 such that the maximum weight that can be applied against the body portion is equivalent to the weight of the carriage 28 and applicator 30, minus the counterbalancing force of the spring 64. In the event that one of the microprocessor or pressure sensing transducer 70 fails, the maximum weight that could be applied to the body portion would be the weight of the carriage 28 and applicator 30 (approximately 45 pounds) less the counterbalancing force of the spring (approximately 35 pounds), which is approximately 10 pounds. Should the linear actuator 58 fail, the carriage 28 would cease moving due to the self-locking nature of the ball screws of the type used in a linear actuator 58 of the present invention. If the spring 64 were to fail, the microprocessor would still maintain the set point pressure on the body as sensed by the pressure transducer 70 by extending or retracting the linear actuator 58. A maximum applied force is set in the microprocessor's software such that the linear actuator 58 will not extend further if the maximum force is reached. Only if the pressure transducer 70 or the microprocessor fails would the first collar 62 disengage from the support arm 48 to mechanically limit the maximum force being applied. Accordingly, the device 10 of the present invention has an inherently mechanical fail safe feature for preventing the applicator 30 from applying an excessive amount of force to the body portion, thereby assisting in preventing damage to the body.

If the user would like to decrease the pressure applied by the applicator 30, the stepper motor 60 is actuated to retract the arm 58*a* of the linear actuator 58 and move the support arm 48 towards the flange 50. When the support arm 48 engages the flange 50, the torsion bar 34 begins to rotate counterclockwise and lift the applicator 30 away from the portion of the body. The degree of lifting of the applicator 30 can be controlled to modify the force applied by the applicator 30, as described in more detail hereinafter.

When the user has completed the massage, the stepper motor 60 is actuated to completely retract the arm 58*a* of the linear actuator 58 and continue to pivot the support arm 48 in the counterclockwise direction to lift and pivot the torsion bar 48 in the counter clockwise direction until the applicator 30 and carriage 28 are in the second position.

The degree of force applied by the applicator 30 is controlled in response to the movement of the surface of lower plate 76 sensed by the transducer 70 of the sensor 88 or by the transducer 102 of the sensor 98. This sensed movement is representative of the force applied by applicator 30. It is communicated to the control unit by the transducer 70 or transducer 102 as a control signal. That is, since the first and second plates 72, 76 can move with respect to each other parallel to the first, second and third axes 22, 24 and 26, the user can adjust the amount of force that the applicator 30 can apply to the body portion being massaged through the use of the joy stick 80. Once the user has selected the desired force to be applied, the control unit monitors the control signal from the transducer 70 or the transducer 102 and actuates the stepper motor 60 and the arm 58*a* of the linear actuator 58 in accordance with the received signals. Thus, if the pressure sensed by sensors 88, 98 corresponds to an applicator 30 force which exceeds the selected limit, the arm 58*a* of the linear actuator 58 is slightly retracted to lift the applicator 30 and reduce the force applied. Similarly, if the pressure within the bladder 68 or foam 100 corresponds to a force which is below the selected limit, the arm 58*a* of the linear actuator is extended to lower the applicator 30 and increase the applied force.

Thus, either sensor 88 or sensor 98 may be used to allow the applicator 30 to be controlled to limit the maximum force along any of the first, second and third axes 22, 24 and 26. For instance, if the applicator 30 moves longitudinally along the axis 22 and upwardly along the back of the person being massaged, the force applied along the longitudinal axis 22 would be sensed by the bladder 68 and communicated to the control unit by the transducer 70 if the sensor 88 is selected. Alternately, these forces would be sensed by the foam pad 100 and transducer 102 if the sensor 98 is selected. Thus, the structure of the first and second plates 72, 76 along with bladder 68 or foam pad 100 permits the control unit to control the applicator 30 to limit the force applied to the body portion parallel to the first, second and third axes 22, 24, 26.

From the foregoing description, it can be seen that the present invention comprises a device for massaging an anatomical portion of a body of a person. It will be appreciated by those skilled in the art that changes and modifications may be made to the above-described embodiment without departing from the broad inventive concept thereof. It is understood, therefore, that the present invention is not limited to the particular embodiment disclosed, but it is intended to include all modifications and changes which are within the scope and spirit of the invention as defined by the appended claims.

I claim:

1. A device for massaging a portion of a body of a person, said device comprising:

a frame;

a body supporting surface mounted on said frame for supporting said body portion;

an applicator supported by said frame proximate said body supporting surface for movement with respect to said body supporting surface to engage and apply force to the body portion along at least two orthogonal axes, said applicator having a predetermined weight;

a single sensor disposed between said applicator and said body portion for sensing said applied force along said two orthogonal axes and determining a single resultant force in response thereto in order to provide a control signal in response to said single resultant force, the single sensor including (a) first and second sensor surfaces spaced apart from each other by a distance and disposed between said applicator and said body portion, and (b) a transducer for providing said control signal in response to the distance between said first and second sensor surfaces; and a control unit coupled to said applicator for moving said applicator between a first position wherein said applicator is in engagement with the body portion and a second position wherein the applicator is disengaged from the body portion in response to said control signal.

2. The device as recited in claim 1, wherein said first and second sensor surfaces are spaced apart from each other by a resilient material disposed therebetween.

3. A device for massaging a portion of a body of a person, said device comprising:

a frame;

a body supporting surface mounted on said frame for supporting said body portion;

an applicator supported by said frame proximate said body supporting surface for movement with respect to said body supporting surface to engage and apply force to the body portion along at least two orthogonal axes, said applicator having a predetermined weight;

a single sensor disposed between said applicator and said body portion for sensing said applied force along said two orthogonal axes and determining a single resultant force in response thereto in order to provide a control signal in response to said single resultant force, the single sensor including (a) a first sensor surface disposed between said applicator and said body portion, and (b) an inductive device having means for determining the position of said first sensor surface and providing said control signal in response to said determined position; and a control unit coupled to said applicator for moving said applicator between a first position wherein said applicator is in engagement with the body portion and a second position wherein the applicator is disengaged from the body portion in response to said control signal.

4. A device for massaging a portion of a body of a person, said device comprising:

a frame;

a body supporting surface mounted on said frame for supporting said body portion;

an applicator supported by said frame proximate said body supporting surface for movement with respect to said body supporting surface to engage and apply force to the body portion along at least two orthogonal axes, said applicator having a predetermined weight;

a single sensor disposed between said applicator and said body portion for sensing said applied force along said two orthogonal axes and determining a single resultant force in response thereto in order to provide a control signal in response to said single resultant force, the single sensor including (a) a bladder having a pressure which varies in accordance with the applied force, and (b) a transducer for determining said varying pressure and providing said control signal in response to said determined pressure; and a control unit coupled to said applicator for moving said applicator between a first position wherein said applicator is in engagement with the body portion and a second position wherein the applicator is disengaged from the body portion in response to said control signal.

5. A device for massaging an anatomical portion of the body of a person, said device comprising:

a frame;

a body supporting surface mounted on said frame for supporting said anatomical portion, said body supporting surface having a first generally horizontal longitudinal axis extending therethrough, a second generally horizontal axis extending generally perpendicular to said longitudinal axis, and a third generally vertical axis extending generally perpendicular to said longitudinal and second axes;

an applicator supported by said frame proximate said body supporting surface for movement with respect to said body supporting surface to engage and apply a force to said anatomical portion, said applicator including a single sensor disposed between said applicator and said anatomical portion, said single sensor including (a) means for sensing the forces applied to said anatomical portion along at least two of said axes and determining a single resultant force in response thereto in order to provide a control signal representative of said single resultant force, (b) a first sensor surface disposed between said applicator and said anatomical portions of said body, and (c) an inductive device for determining the position of said first sensor surface and providing said control signal in response to said determined position; and a control unit supported by said frame for moving said applicator between a first position wherein said applicator is in engagement with said anatomical portion and a second position wherein said applicator is disengaged from said anatomical portion in response to said control signal.

6. A device for massaging an anatomical portion of the body of a person, said device comprising:

a frame;

a body supporting surface mounted on said frame for supporting said anatomical portion, said body supporting surface having a first generally horizontal longitudinal axis extending therethrough, a second generally horizontal axis extending generally perpendicular to said longitudinal axis, and a third generally vertical axis extending generally perpendicular to said longitudinal and second axes;

an applicator supported by said frame proximate said body supporting surface for movement with respect to said body supporting surface to engage and apply a force to said anatomical portion, said applicator including a single sensor disposed between said applicator and said anatomical portion, said single sensor including (a) means for sensing the forces applied to said anatomical portion along at least two of said axes and determining a single resultant force in response thereto in order to provide a control signal representative of said single resultant force, (b) a bladder having a sensor pressure which varies in accordance with said applied force, and (c) a pressure determining device for determining said sensor pressure and providing said control signal in response to said determined sensor pressure; and a control unit supported by said frame for moving said applicator between a first position wherein said applicator is in engagement with said anatomical portion and a second position wherein said applicator is disengaged from said anatomical portion in response to said control signal.

7. The device as recited in claim 6, wherein said bladder is generally annular shaped in cross section.

8. A device for massaging a portion of a body of a person, said device comprising:

a frame;

a body supporting surface mounted on said frame for supporting said body portion;

an applicator supported by said frame proximate said body supporting surface for movement with respect to said body supporting surface to engage and apply a force to the body portion, said applicator having a predetermined weight;

a sensor disposed between said applicator and said body portion for sensing said applied force, said sensor including a sensor surface and an inductive transducer device, said inductive transducer device determining the position of said sensor surface and having a transducer pressure representative of said sensed force for providing a control signal in response to said determined position; and a control unit coupled to said applicator for moving said applicator between a first position wherein said applicator is in engagement with said body portion and a second position wherein said applicator is disengaged from said body portion in response to said control signal.

9. A device for massaging an anatomical portion of the body of a person, said device comprising:

a frame;

a body supporting surface mounted on said frame for supporting the body portion, said body supporting surface having a first generally horizontal longitudinal axis extending therethrough, a second generally horizontal axis extending generally perpendicular to said longitudinal axis, and a third generally vertical axis extending generally perpendicular to said longitudinal and second axes;

applicator means supported by said frame proximate said body supporting surface for movement with respect to said body supporting surface to engage and apply a force to the body portion, said applicator means including sensor means for determining the force applied to the body portion parallel to at least two of said axes;

control means supported by said frame for moving said applicator means between a first application position wherein said applicator means is in engagement with the body portion and a second application position wherein said applicator means is disengaged from the body portion;

a carriage mounted to said frame and movable with respect thereto;

said applicator means including an applicator extending from said carriage for engagement with the body portion to apply said force to the body portion, said sensor means being positioned between said carriage and said applicator means for sensing forces applied therebetween corresponding to said force applied to the body portion;

said sensor means being a pressure transducer positioned between said carriage and said applicator means for sensing forces applied therebetween corresponding to said force applied to the body portion and providing to said control means a signal corresponding to said force applied to the body portion; and said pressure transducer being positioned between a first plate coupled to said carriage and a second plate coupled to said applicator means, said first and second plates extending generally parallel with respect to each other and being movable with respect each other along said longitudinal axis, said second axis and said third axis.

10. The device of claim 9, wherein said transducer is a bladder.

* * * * *